US009416572B2

(12) United States Patent
Tolliver

(10) Patent No.: US 9,416,572 B2
(45) Date of Patent: Aug. 16, 2016

(54) ADJUSTABLE SWING-CONTROLLED HINGE

(71) Applicant: Peter M. Tolliver, Rochester, NY (US)

(72) Inventor: Peter M. Tolliver, Rochester, NY (US)

( * ) Notice: Subject to any disclaimer, the term of this patent is extended or adjusted under 35 U.S.C. 154(b) by 0 days.

(21) Appl. No.: 14/750,106

(22) Filed: Jun. 25, 2015

(65) Prior Publication Data

US 2016/0160545 A1 Jun. 9, 2016

Related U.S. Application Data

(60) Provisional application No. 62/088,816, filed on Dec. 8, 2014, provisional application No. 62/088,826, filed on Dec. 8, 2014.

(51) Int. Cl.

| | |
|---|---|
| ***E05D 5/10*** | (2006.01) |
| ***E05D 3/02*** | (2006.01) |
| ***E05D 11/06*** | (2006.01) |

(52) U.S. Cl.

CPC .. *E05D 5/10* (2013.01); *E05D 3/02* (2013.01); *E05D 11/06* (2013.01); *E05D 2005/106* (2013.01); *Y10T 16/551* (2015.01)

(58) Field of Classification Search

CPC ..... E05D 5/10; E05D 11/06; E05D 3/02; E05D 2005/106; E05D 5/14; Y10T 16/551; Y10T 16/557; Y10T 16/54038; Y10T 16/5535; Y10T 16/54028

USPC ..... 16/374, 386, 342, 381, 334

See application file for complete search history.

(56) References Cited

U.S. PATENT DOCUMENTS

| | | | | |
|---|---|---|---|---|
| 1,440,713 | A | 1/1923 | Ausbourne | |
| 3,000,049 | A * | 9/1961 | Terry, Jr. | B29C 45/0017 16/334 |
| 3,538,539 | A * | 11/1970 | Clifford | E05D 11/06 16/375 |
| 5,187,837 | A | 2/1993 | Gunderson et al. | |
| 5,237,724 | A | 8/1993 | Lee | |
| 5,265,922 | A | 11/1993 | Falcone | |
| 5,287,596 | A | 2/1994 | Chen et al. | |
| 5,311,644 | A | 5/1994 | Laforgerie | |
| 5,727,289 | A | 3/1998 | Reder | |
| 5,799,370 | A | 9/1998 | Davidian et al. | |
| 6,353,967 | B1 | 3/2002 | Escobar et al. | |
| 6,497,005 | B2 | 12/2002 | Apostoloff | |
| 8,099,834 | B2 * | 1/2012 | Corso | E05D 5/12 16/342 |
| 8,307,513 | B1 * | 11/2012 | Fitzgerald | E05D 11/06 16/344 |
| 8,739,366 | B2 * | 6/2014 | Heninger | E05D 5/10 16/374 |
| 2009/0151124 | A1 * | 6/2009 | Forrest | E05D 5/14 16/374 |
| 2012/0240354 | A1 * | 9/2012 | Heninger | E05D 5/10 16/374 |
| 2013/0104345 | A1 * | 5/2013 | Granberry | E05D 11/06 16/374 |
| 2013/0219664 | A1 * | 8/2013 | Burda | E05D 11/06 16/374 |

* cited by examiner

*Primary Examiner* — William Miller

(74) *Attorney, Agent, or Firm* — Michael J. Nickerson; Basch & Nickerson LLP

(57) ABSTRACT

A hinge, providing a swinging function for a first object attached thereto with respect to a stationary object attached thereto, includes a first leaf; a second leaf; and a pintle. The first leaf has a first knuckle. The second leaf has a second knuckle forming a volume for receiving said pintle. The second knuckle has a contact arm located within the volume. The pintle has a first stop surface feature and a second stop surface feature. The first stop surface feature causes the swinging function of the first object to stop when the contact arm of the second knuckle engages, by contact, the first stop surface feature. The second stop surface feature causes the swinging function of the first object to stop when the contact arm of the second knuckle engages, by contact, the second stop surface feature.

19 Claims, 12 Drawing Sheets

ADJUSTABLE SWING-CONTROLLED HINGE

PRIORITY INFORMATION

This application claims priority, under 35 U.S.C. §119(e), from U.S. Provisional Patent Application, Ser. No. 62/088,816, filed on Dec. 8, 2014. The entire content of U.S. Provisional Patent Application, Ser. No. 62/088,816, filed on Dec. 8, 2014, is hereby incorporated by reference.

This application further claims priority, under 35 U.S.C. §119(e), from U.S. Provisional Patent Application, Ser. No. 62/088,826, filed on Dec. 8, 2014 The entire content of U.S. Provisional Patent Application, Ser. No. 62/088,826, filed on Dec. 8, 2014, is hereby incorporated by reference.

BACKGROUND

A conventional hinge, as illustrated in FIG. 1, is comprised of a first leaf 30, second leaf 20, and a pintle 60. With respect to the first leaf 30 and second leaf 20, the first leaf 30 has circular knuckles 40, and second leaf 20 has circular knuckles 50, as part of its construction. The circular knuckles (40 and 50) are aligned alternately to form a circular cylindrical metal tube into which a pintle 60 is extended to enable the leaves to swing freely.

It is noted that if the first leaf 30 is attached a door, the circular knuckles 50 are stationary with respect to the pintle 60, and the circular knuckles 40 rotate around the pintle 60 as the first leaf 30 moves.

It is further noted that if the second leaf 20 is attached a door, the circular knuckles 40 are stationary with respect to the pintle 60, and the circular knuckles 50 rotate around the pintle 60 as the second leaf 20 moves.

An example of a conventional hinge is described in U.S. Pat. No. 6,497,005. U.S. Pat. No. 6,497,005 discloses an adjustable doorstop mounts on a hinge pin that is inserted into mating hinge leafs. The doorstop has two members that are manually positioned with respect to each other and lock to set how far the door to which they are mounted can open. The doorstop members each have a means that contact only a hinge leaf of a door hinge to prevent a door from opening beyond its manually predetermined point. The entire content of U.S. Pat. No. 6,497,005 is hereby incorporated by reference.

Another example of a conventional hinge is described in U.S. Pat. No. 5,799,370. U.S. Pat. No. 5,799,370 discloses an adjustable hinge with a first leaf and an adjustable leaf mounting assembly which includes a second leaf, a bracket, a cam, and an adjusting screw. The second leaf is mounted on the bracket and has one end extending beyond the bracket and pivotally engaged with the first leaf. The cam is rotatably mounted on the bracket and cooperates with a cam follower surface on the second leaf. The entire content of U.S. Pat. No. 5,799,370 is hereby incorporated by reference.

A further example of a conventional hinge is described in U.S. Pat. No. 5,727,289. U.S. Pat. No. 5,727,289 discloses a first and second pair of door stop elements mounted to an existing door hinge and aligned with the barrels on the door hinge. The barrels have to be cutaway to mount the stops. The hinge pin holds everything in position. One of the pair of door stops is shaped like a metal bar with a pair of knuckles at the top and the bottom. It also has curves, indentations, flat contact points, and grooves. The back of the first stop is recessed to provide clearance to avoid the hinge barrels against which the stop is positioned after installation. The flat contact points abut against the faces of the pair of door hinges to prevent the door from opening beyond a fixed point. The first stop is used alone when the door opens up to 180 degrees. The second stop works with the first stop element and is used to limit the door opening to much less than 180 degrees. The entire content of U.S. Pat. No. 5,727,289 is hereby incorporated by reference.

A fourth example of a conventional hinge is described in U.S. Pat. No. 6,353,967. U.S. Pat. No. 6,353,967 discloses a door hinge which stops the swing-open motion of a door before it can strike an adjacent wall located at ninety degrees to the closed door. By stopping the motion of the door at ninety degrees, the protruding hardware of the door will not penetrate or otherwise damage the adjacent wall. Frequent repairs are therefore avoided. The door hinge is adaptable to various residential and commercial applications. The entire content of U.S. Pat. No. 6,353,967 is hereby incorporated by reference.

A fifth example of a conventional hinge is described in U.S. Pat. No. 5,311,644. U.S. Pat. No. 5,311,644 discloses a door hinge having a particularly reliable and solid stop and holding device. The movable part of the hinge lies along the hinge pin between the fixed part and a housing which contains the holding mechanism and is integral with the fixed part. In the housing, a pivotable lever is rotationally fastened to the movable part and supports a roller against which one or more notches are pushed by a spring-loaded device. The notches define the open positions of the door. The housing is sealed and fits onto the fixed part and the hinge pin. The hinge can be used particularly in motor vehicle doors. The entire content of U.S. Pat. No. 5,311,644 is hereby incorporated by reference.

Another example of a conventional hinge is described in U.S. Pat. No. 5,287,596. U.S. Pat. No. 5,287,596 discloses a universal hinge with the capability of performing stop and hold mechanisms without installing extra stop and/or catch components on an object abutted to the universal hinge. The universal hinge comprises a hinge body, a stop mechanism, and a hold mechanism. Both the stop mechanism and the hold mechanism of the universal hinge are provided by specially shaped hinge knuckles while no extra component is needed. The entire content of U.S. Pat. No. 5,287,596 is hereby incorporated by reference.

Another example of a conventional hinge is described in U.S. Pat. No. 5,265,922. U.S. Pat. No. 5,265,922 discloses a detachable door lock having a door contact member which is secured to a door frame contact member. A spacer is provided between the door contact member and the door frame contact member so as to position the two members in contact with the door and the door frame, respectively. The door contact member and the door frame contact member, as well as the spacer, are releasably secured to the door hinge to maintain the door contact member in contact with the door and the door frame contact member in contact with the door frame. The door lock limits the amount of rotation of the door about the hinge and thus prevents entry through the doorway when the door is closed and the lock is attached to the hinge. The door lock may be adjusted so as to conform to various door and door frame configurations as well as to permit limited opening of the door. The entire content of U.S. Pat. No. 5,265,922 is hereby incorporated by reference.

Another example of a conventional hinge is described in U.S. Pat. No. 5,187,837. U.S. Pat. No. 5,187,837 discloses a mullion mounted door hinge assembly for pivotally guiding upper and lower doors of a refrigerator. The hinge assembly includes a bracket which slidably accepts a generally cylindrical hinge pin. The hinge pin has a larger diameter center section and a pair of relatively smaller diameter end sections. Each of the end sections of the hinge pin extend into an accommodating opening in the upper or lower doors. The upper door is supported on an upwardly directed surface of the center section. A downwardly directed surface of the center section is supported by the lower door. A substantial portion of the weight of the upper door is transferred to the lower door and supported by the lower hinge means. The entire content of U.S. Pat. No. 5,187,837 is hereby incorporated by reference.

Another example of a conventional hinge is described in U.S. Pat. No. 5,237,724. U.S. Pat. No. 5,237,724 discloses a hinge pin swing stop which is coupled to the hinge pin of a door hinge or other hinged object and acts to limit the rotating swing of that object about the hinge. The swing stop can include a section which acts as the replacement hinge pin, a first extension which bears upon the solidly backed structure of a door or other object, and an angular extension which is brought into interfering contact with a structurally solid support to which the hinged object is attached. The point at which swing stopping interferences are encountered is selectedly adjustable. The entire content of U.S. Pat. No. 5,237,724 is hereby incorporated by reference.

Another example of a conventional hinge is described in U.S. Pat. No. 1,440,713. U.S. Pat. No. 1,440,713 discloses a hinge, which is self-locking to hold a door closed or opened and at intermediate points. The locking mechanism can be thrown out of operation when it is not desired to be used. The pintle forms a part of the locking mechanism and can adjust the locking mechanism in and out of an operative position. The pintle will not rotate when the door is being opened or closed. The entire content of U.S. Pat. No. 1,440,713 is hereby incorporated by reference.

The various conventional embodiments, described above, may require additional hardware and can be complex to realize the stopping function.

Moreover, the various conventional embodiments, described above, fail to provide different types of stopping mechanisms.

Therefore, it is desirable to provide a door hinge which provides a user defined swing arc.

It is further desirable to provide a door hinge which provides a user defined swing arc with a gradual stopping force being applied before an end of the user defined swing arc is reached.

In addition, it is desirable to provide a door hinge which provides a user defined swing arc with interchangeable stopping mechanisms for providing the stopping function at an end of the user defined swing arc.

BRIEF DESCRIPTION OF THE DRAWING

The drawings are only for purposes of illustrating various embodiments and are not to be construed as limiting, wherein.

DETAILED DESCRIPTION

Figure 1:
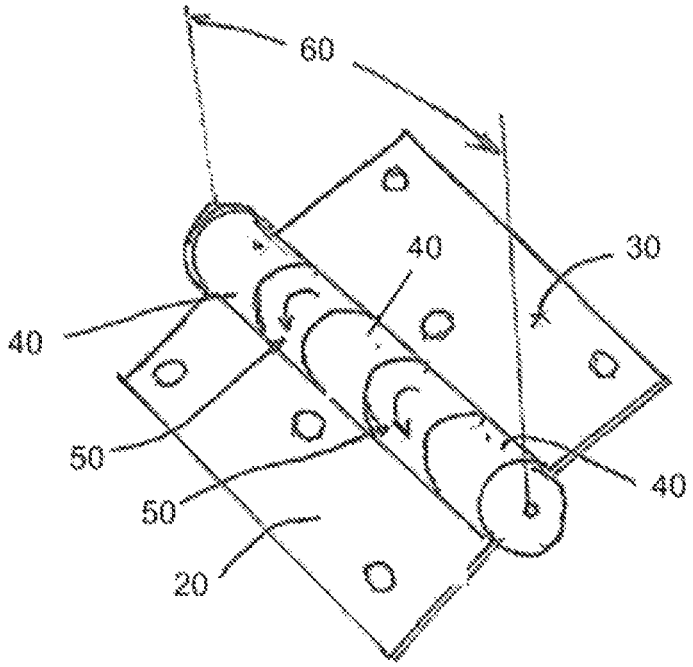
Prior Art FIG. 1
FIG. 1 illustrates a prior art door hinge.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

Figure 2:
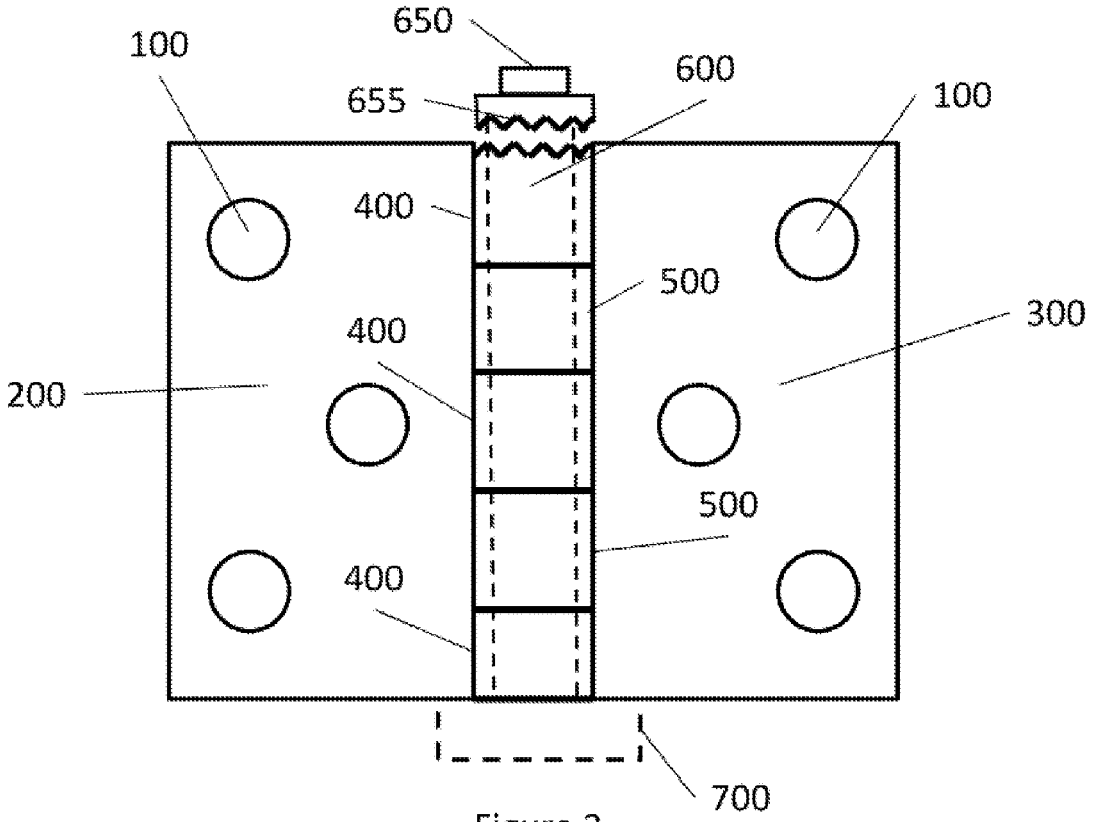
FIG. 2 illustrates an adjustable swing-controlled hinge.

FIG. 2 illustrates an adjustable swing-controlled hinge. As illustrated in FIG. 2, the adjustable swing-controlled hinge includes a first hinge leaf 200, which includes openings 100 to enable the attaching of the first hinge leaf 200 to a door or a door frame. The adjustable swing-controlled hinge includes a second hinge leaf 300, which includes openings 100 to enable the attaching of the second hinge leaf 300 to a door or a door frame.

The first hinge leaf 200 includes knuckles 400, which form a cylindrical volume that is capable of receiving a pintle 600. The second hinge leaf 300 includes knuckles 500, which form a cylindrical volume that is capable of receiving pintle 600.

Each knuckle includes an axial dimension and a radius dimension. Moreover, the pintle 600 has an axial dimension and a radius dimension.

As illustrated in FIG. 2, the axial dimension of the pintle 600 is greater than a total of the axial dimensions of all knuckles. Moreover, as illustrated in FIG. 2, the radius dimension of the pintle 600 is less than the radius dimension of the knuckles.

It is noted that the knuckles 400 of first hinge leaf 200 are offset from knuckles 500 of second hinge leaf 300 such that when first hinge leaf 200 properly engages, as illustrated in FIG. 2, second hinge leaf 300, knuckles 400 and knuckles 500 form a cylindrical volume that is capable of receiving pintle 600.

Additionally, as illustrated in FIG. 2, pintle 600 includes teeth 655, which engage or bite into a knuckle 400 of the first hinge leaf 200 so that the pintle 600 does not move with respect to the knuckle 400 of the first hinge leaf 200 when the pintle 600 is engaged thereto.

It is noted that the knuckle 400 of the first hinge leaf 200 may include corresponding teeth to engage the teeth 655 of pintle 600.

Alternatively, the teeth 655 of pintle 600 may engage or bite into the knuckle 400 of the first hinge leaf 200 upon the application of an appropriate force so that the teeth 655 of pintle 600 bite into the knuckle 400 of the first hinge leaf 200, thereby preventing movement of the pintle 600 with respect to the knuckle 400 of the first hinge leaf 200.

It is noted that the engagement of the pintle 600 with the knuckle 400 of the first hinge leaf 200 also allows the pintle 600 to move with the knuckle 400 of the first hinge leaf 200. In other words, the pintle 600 does not move with respect to the knuckle 400 of the first hinge leaf 200, but the pintle 600 is attached or secured to the knuckle 400 of the first hinge leaf 200 so that the pintle 600 moves in conjunction with the movement of the knuckle 400 of the first hinge leaf 200.

Optionally, pintle 600 may include a pintle cap 700, into which the pintle 600 screws (the pintle 600 having screw threads at an end opposite the end having teeth 655), thereby securing the engagement of the teeth 655 of pintle 600 with the knuckle 400 of the first hinge leaf 200 to prevent movement of the pintle 600 with respect to the knuckle 400 of the first hinge leaf 200.

Pintle 600 also includes a knob 650 to assist a user to lift the pintle 600 to disengage the pintle 600 from the knuckle. Upon disengagement, the pintle 600 can be rotated a desired distance and direction and then re-engaged with the knuckle.

The rotation of the pintle 600 changes the position of the hinge's swing arc, as will be discussed in more detail below.

It is noted that the pintle cap 700 may be integral to pintle 600, wherein pintle 600 (the pintle 600 having screw threads at an end which would engage the knob 650) would screw into the knob 650, thereby securing the engagement of the teeth 655 of pintle 600 with the knuckle to prevent movement of the pintle 600 with respect to the knuckle.

Figure 3:
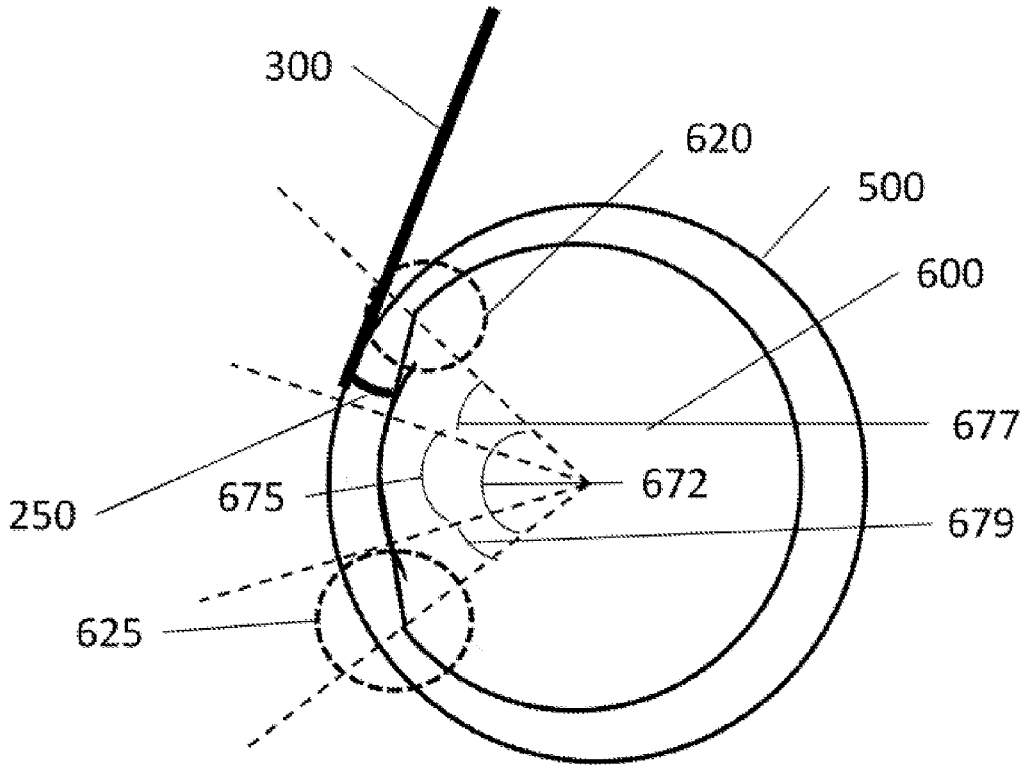
FIG. 3 illustrates a pintle, hinge leaf, and a hinge knuckle with a contact arm for an adjustable swing-controlled hinge having a first gradual stop end and a second gradual stop end.

FIG. 3 illustrates a pintle 600, second hinge leaf 300, and a hinge knuckle 500 with a contact arm 250 for an adjustable swing-controlled hinge. The pintle 600 has a first gradual stop end 620 and a second gradual stop end 625.

As illustrated in FIG. 3, the pintle 600 includes a swing arc 672, which, as illustrated in FIG. 3, is composed of a free swing arc 675, a first gradual slowing swing arc 677, and a second gradual slowing swing arc 679.

It is noted that the swing arc 672 of pintle 600 may be composed of different combinations of free swing arcs and/or gradual slowing swing arcs, as will be discussed below with respect to FIGS. 4-7.

The contact arm 250 is located near the intersection of the hinge leaf 300 and the corresponding knuckle 500. The actual swing arc of the adjustable swing-controlled hinge is controlled by the interaction of a contact arm 250 and the pintle 600, as the contact arm 250 traverses the swing arc 672 of the pintle 600.

If the second hinge leaf 300 is attached to a wall, door frame, or other stationary object and the corresponding first hinge leaf 200 is attached to the swinging member; such as a door, gate, etc.; the pintle 600 will rotate in conjunction with the rotation of the knuckle 400 of the first hinge leaf 200 because, as noted above, the engagement of the pintle 600 with the knuckle 400 of the first hinge leaf 200 also allows the pintle 600 to move with the knuckle 400 of the first hinge leaf 200.

The combination of the movement of the pintle 600 (tied to swinging hinge leaf) and the stationary state of the contact arm 250 (tied to stationary hinge leaf) causes relative movement between the surface of the pintle 600 and the contact arm 250, thereby causing the contact arm 250 to traverse the swing arc 672 of the pintle 600.

If the second hinge leaf 300 is attached to the swinging member; such as a door, gate, etc.; and the corresponding first hinge leaf 200 is attached to a wall, door frame, or other stationary object, the pintle 600 will not rotate, but the contact arm 250 will move in conjunction with the rotation of the knuckle 500 of the second hinge leaf 300 because, as noted above the engagement of the pintle 600 with the knuckle 400 of the first hinge leaf 200 prevents movement of the pintle 600 with respect to the knuckle 400 of the first hinge leaf 200.

The combination of the stationary state of the pintle 600 (tied to stationary hinge leaf) and the movement of the contact arm 250 (tied to swinging hinge leaf) causes relative movement between the surface of the pintle 600 and the contact arm 250, thereby causing the contact arm 250 to traverse the swing arc 672 of the pintle 600.

More specifically, as the contact arm 250 traverses the free swing arc 675 of the swing arc 672, the contact arm 250 does not contact the pintle 600, thereby enabling a free swing area.

On the other hand, as the contact arm 250 traverses from the free swing arc 675 of the swing arc 672 to the first gradual stop end 620, the contact arm 250 traverses the first gradual slowing swing arc 677.

The first gradual slowing swing arc 677 is an area where the contact arm 250 contacts the pintle 600. Moreover, the first gradual slowing swing arc 677 is an area where the distance between the outer surface of the pintle 600 and the inner surface of the knuckle 500 decreases as the outer surface of the pintle 600 is closer to the first gradual stop end 620.

More specifically, as illustrated in FIG. 3, as the contact arm 250 traverses from the free swing arc 675 of the swing arc 672 to the first gradual stop end 620, the contact arm 250 encounters a smaller and smaller distance between the outer surface of the pintle 600 and the inner surface of the knuckle 500, thereby increasing the friction between the contact arm 250 and the pintle 600 and effectively slowing down the swing of the second hinge leaf 300.

The gradual slowing of the swing of the second hinge leaf 300 becomes an actual stopping of the swing of the second hinge leaf 300 when the contact arm 250 engages the first gradual stop end 620, thereby allowing the second hinge leaf 300 to come to a stop position in a gradual manner.

Furthermore, as the contact arm 250 traverses from the free swing arc 675 of the swing arc 672 to the second gradual stop end 625, the contact arm 250 traverses the second gradual slowing swing arc 679.

The second gradual slowing swing arc 679 is an area where the contact arm 250 contacts the pintle 600. Moreover, the second gradual slowing swing arc 679 is an area where the distance between the outer surface of the pintle 600 and the inner surface of the knuckle 500 decreases as the outer surface of the pintle 600 is closer to the second gradual stop end 625.

More specifically, as illustrated in FIG. 3, as the contact arm 250 traverses from the free swing arc 675 of the swing arc 672 to the second gradual stop end 625, the contact arm 250 encounters a smaller and smaller distance between the outer surface of the pintle 600 and the inner surface of the knuckle 500, thereby increasing the friction between the contact arm 250 and the pintle 600 and effectively slowing down the swing of the second hinge leaf 300.

The gradual slowing of the swing of the second hinge leaf 300 becomes an actual stopping of the swing of the second hinge leaf 300 when the contact arm 250 engages the second gradual stop end 625, thereby allowing the second hinge leaf 300 to come to a stop position in a gradual manner.

Figure 4:
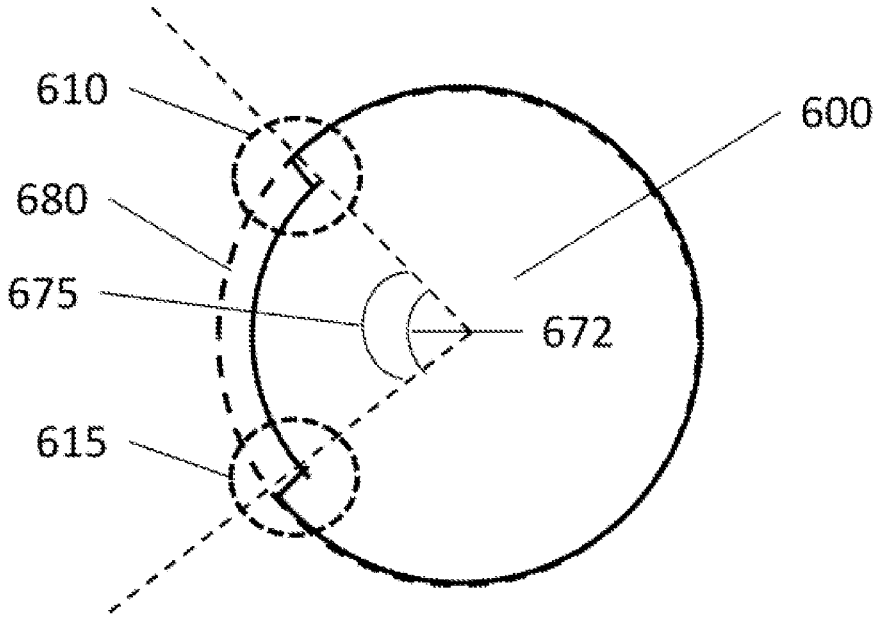
FIG. 4 illustrates a pintle for an adjustable swing-controlled hinge having a first abrupt stop end and a second abrupt stop end.

FIG. 4 illustrates a pintle 600 with a first abrupt stop end 610 and a second abrupt stop end 615. As illustrated in FIG. 4, the swing arc 672 is composed of a free swing arc 675.

In other words, if the adjustable swing-controlled hinge of FIG. 3 utilized the pintle 600 of FIG. 4, the contact arm 250 would not contact the pintle 600, as the contact arm 250 traverses the swing arc 672.

However, the swinging hinge leaf would come to an abrupt stop when the contact arm 250 engages either the first abrupt stop end 610 or the second abrupt stop end 615.

Thus, when adjustable swing-controlled hinge utilizes the pintle 600 of FIG. 4, the adjustable swing-controlled hinge does not impose a gradual slowing of the hinge leaf as the hinge leaf approaches a stopping position.

It is noted that dashed line 680 of FIG. 4 represents the outer surface of the pintle 600 if the modification were not made to create the swing arc 672.

Figure 5:
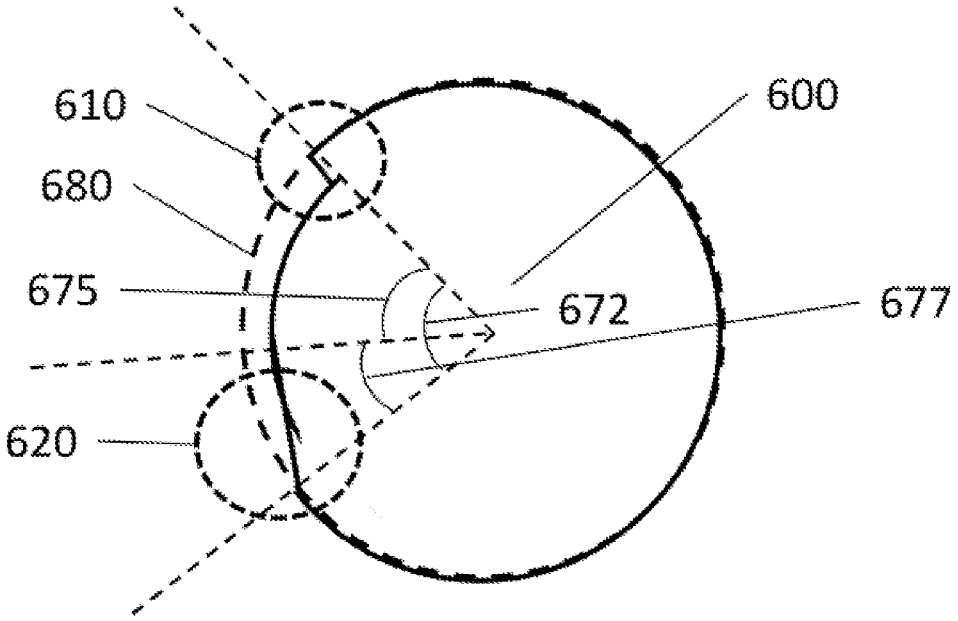
FIG. 5 illustrates a pintle for an adjustable swing-controlled hinge having an abrupt stop end and a gradual stop end.

FIG. 5 illustrates a pintle 600 with a first abrupt stop end 610 and a first gradual stop end 620. As illustrated in FIG. 5, the swing arc 672 is composed of a free swing arc 675 and a first gradual slowing swing arc 677.

In other words, if the adjustable swing-controlled hinge of FIG. 3 utilized the pintle 600 of FIG. 5, the contact arm 250 would not contact the pintle 600 as the contact arm 250 traverses the swing arc 672, but would contact the pintle 600 as the contact arm 250 traverses the first gradual slowing swing arc 677.

As illustrated in FIG. 5, the swinging hinge leaf would come to an abrupt stop when the contact arm 250 engages the first abrupt stop end 610.

However, the swinging hinge leaf would come to a gradual stop when the contact arm 250 traverses first gradual slowing swing arc 677 in the direction of the first gradual stop end 620.

Thus, when adjustable swing-controlled hinge utilizes the pintle 600 of FIG. 5, the adjustable swing-controlled hinge does not impose a gradual slowing of the hinge leaf as the hinge leaf approaches a stopping position in one direction (clockwise), but imposes a gradual slowing of the hinge leaf as the hinge leaf approaches a stopping position in the opposite direction (counter-clockwise).

It is noted that dashed line 680 of FIG. 5 represents the outer surface of the pintle 600 if the modification were not made to create the swing arc 672.

Figure 6:
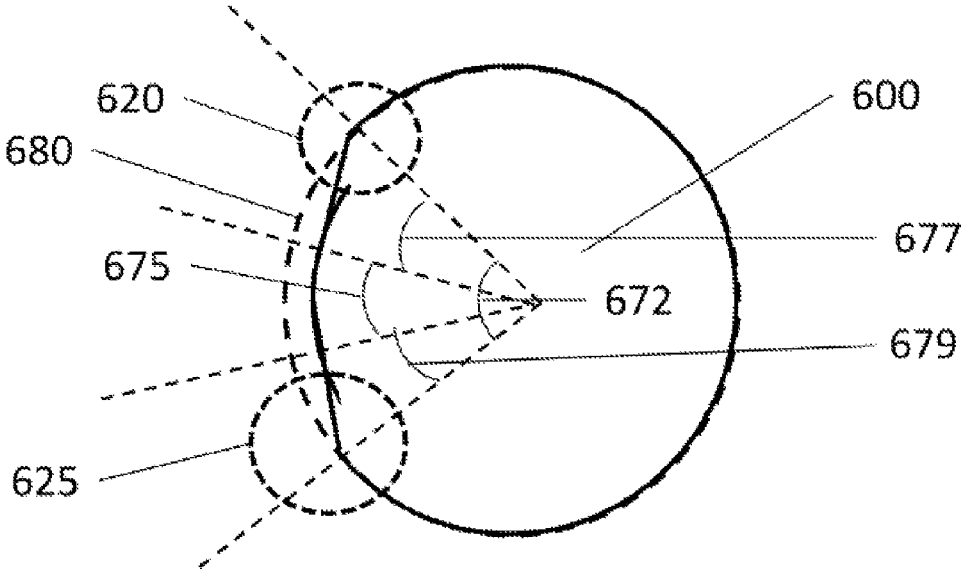
FIG. 6 illustrates a pintle for an adjustable swing-controlled hinge having a first gradual stop end and a second gradual stop end.

FIG. 6 illustrates a pintle 600 with a first gradual stop end 620 and a second gradual stop end 625. As illustrated in FIG. 6, the swing arc 672 is composed of a free swing arc 675, a first gradual slowing swing arc 677, and a second gradual slowing swing arc 679.

In other words, if the adjustable swing-controlled hinge of FIG. 3 utilized the pintle 600 of FIG. 6, the contact arm 250 would not contact the pintle 600 as the contact arm 250 traverses the swing arc 672, but would contact the pintle 600 as the contact arm 250 traverses the first gradual slowing swing arc 677 or the second gradual slowing swing arc 679.

As illustrated in FIG. 6, the swinging hinge leaf would come to a gradual stop when the contact arm 250 traverses first gradual slowing swing arc 677 in the direction of the first gradual stop end 620.

Moreover, the swinging hinge leaf would come to a gradual stop when the contact arm 250 traverses first gradual slowing swing arc 679 in the direction of the first gradual stop end 625.

Thus, when adjustable swing-controlled hinge utilizes the pintle 600 of FIG. 6, the adjustable swing-controlled hinge imposes a gradual slowing of the hinge leaf as the hinge leaf approaches the stopping positions in both directions.

It is noted that dashed line 680 of FIG. 6 represents the outer surface of the pintle 600 if the modification were not made to create the swing arc 672.

Figure 7:
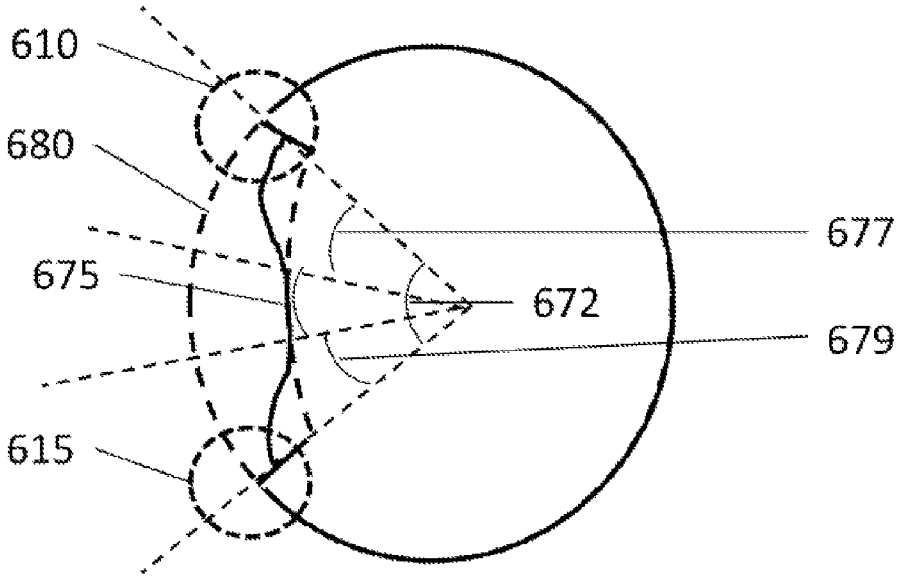
FIG. 7 illustrates a pintle for an adjustable swing-controlled hinge having a first gradual-to-abrupt stop end and a second gradual-to-abrupt stop end.

FIG. 7 illustrates a pintle 600 with a first abrupt stop end 610 and a second abrupt stop end 615. However, as illustrated in FIG. 7 unlike FIG. 4, the swing arc 672 is composed of a free swing arc 675, a first gradual slowing swing arc 677, and a second gradual slowing swing arc 679.

In other words, if the adjustable swing-controlled hinge of FIG. 3 utilized the pintle 600 of FIG. 7, the contact arm 250 would not contact the pintle 600 as the contact arm 250 traverses the swing arc 672, but would contact the pintle 600 as the contact arm 250 traverses the first gradual slowing swing arc 677 or the second gradual slowing swing arc 679.

As illustrated in FIG. 7, the swinging hinge leaf would come to an abrupt stop when the contact arm 250 engages first abrupt stop end 610; however, the swinging hinge leaf would be slowed because the contact arm 250 traverses the first gradual slowing swing arc 677 in the direction of the first abrupt stop end 610.

Moreover, the swinging hinge leaf would come to an abrupt stop when the contact arm 250 engages second abrupt stop end 620; however, the swinging hinge leaf would be slowed because the contact arm 250 traverses the second gradual slowing swing arc 679 in the direction of the second abrupt stop end 620.

Thus, when adjustable swing-controlled hinge utilizes the pintle 600 of FIG. 7, the adjustable swing-controlled hinge imposes a gradual slowing of the hinge leaf as the hinge leaf approaches the stopping positions in both directions, but the actual stopping of the swinging of the hinge is abrupt.

It is noted that dashed line 680 of FIG. 7 represents the outer surface of the pintle 600 if the modification were not made to create the swing arc 672.

As noted above, the pintle 600 can be rotated with respect to the knuckles. The rotation of the pintle 600 changes the location of the swing arc 672 with respect to the hinge leaf attached to the door frame, thereby changes the location or the arc of door swing.

Figure 8:
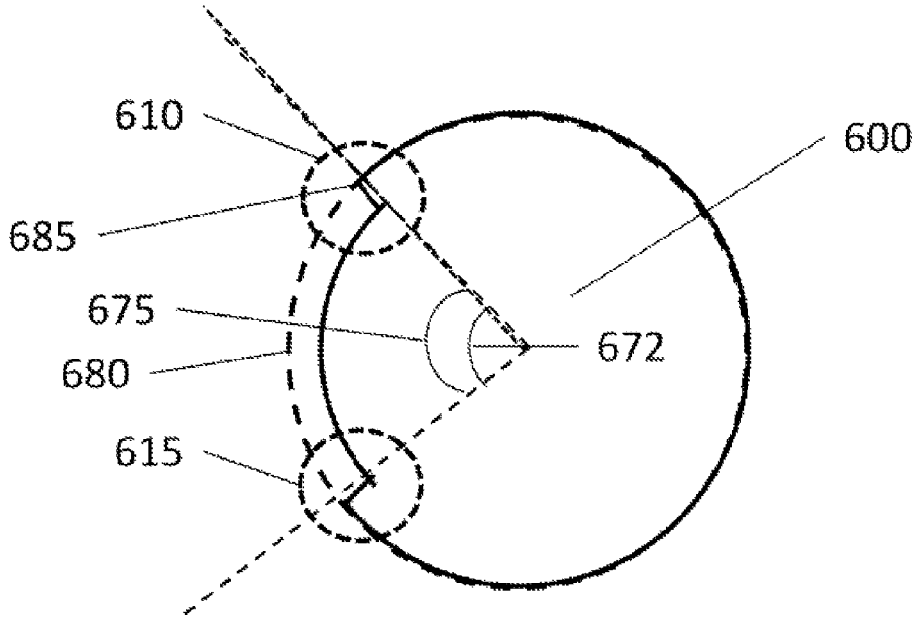
FIG. 8 illustrates a pintle for an adjustable swing-controlled hinge, wherein a stop location corresponds to a closed door position.

For example, as illustrated in FIG. 8, the swing arc 672 of the pintle 600 represents ninety degrees and the first abrupt stop end 610 corresponds the closed door location 685, wherein the closed door location 685 is where the first hinge leaf 200 and the second hinge leaf 300 come in contact when the door is closed.

Figure 9:
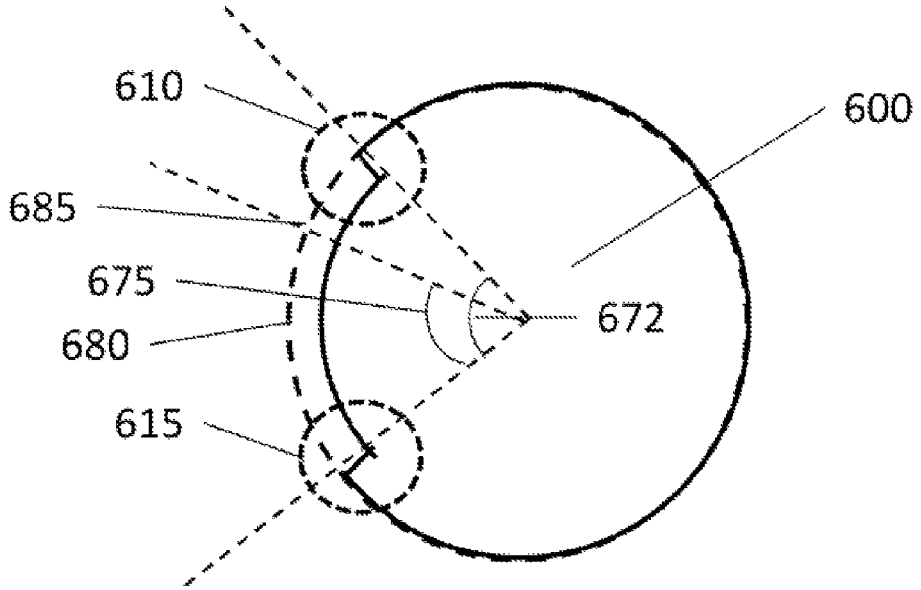
FIG. 9 illustrates a rotating of the pintle of FIG. 8 to change a stop location to effectively reduced the swing arc of the door.

However, if the user desires an effective swing arc of seventy-five degrees, the pintle 600 can be rotated, as illustrated in FIG. 9, so that the first abrupt stop end 610 cannot be engaged by the contact arm 250 because the first hinge leaf 200 and the second hinge leaf 300 will come in contact, at the closed door location 685, before the engagement.

The moving of the first abrupt stop end 610 beyond the closed door location 685 reduces the angle associated with the swing arc 672, and thus, with an appropriate rotation of the pintle 600, an effective swing arc of seventy-five degrees can be realized when a pintle 600 having a swing arc of ninety degrees is utilized in the adjustable swing-controlled hinge.

It is noted that if the pintle 600 of FIG. 8 is rotated in a direction opposite of the rotation realized in FIG. 9, the first abrupt stop end 610 would be on a front side of the closed door location 685, thus shifting the swing arc location so that the door associated with the adjustable swing-controlled hinge would not effectively close all the way.

Thus, the rotation of the pintle 600 can reduce the effective swing arc or shift the location of the swing arc.

It is noted that the adjustable swing-controlled hinge can utilize pintles having various swing arcs so that rotation of the pintle may not be necessary to realize the desired swing arc.

Figure 10:
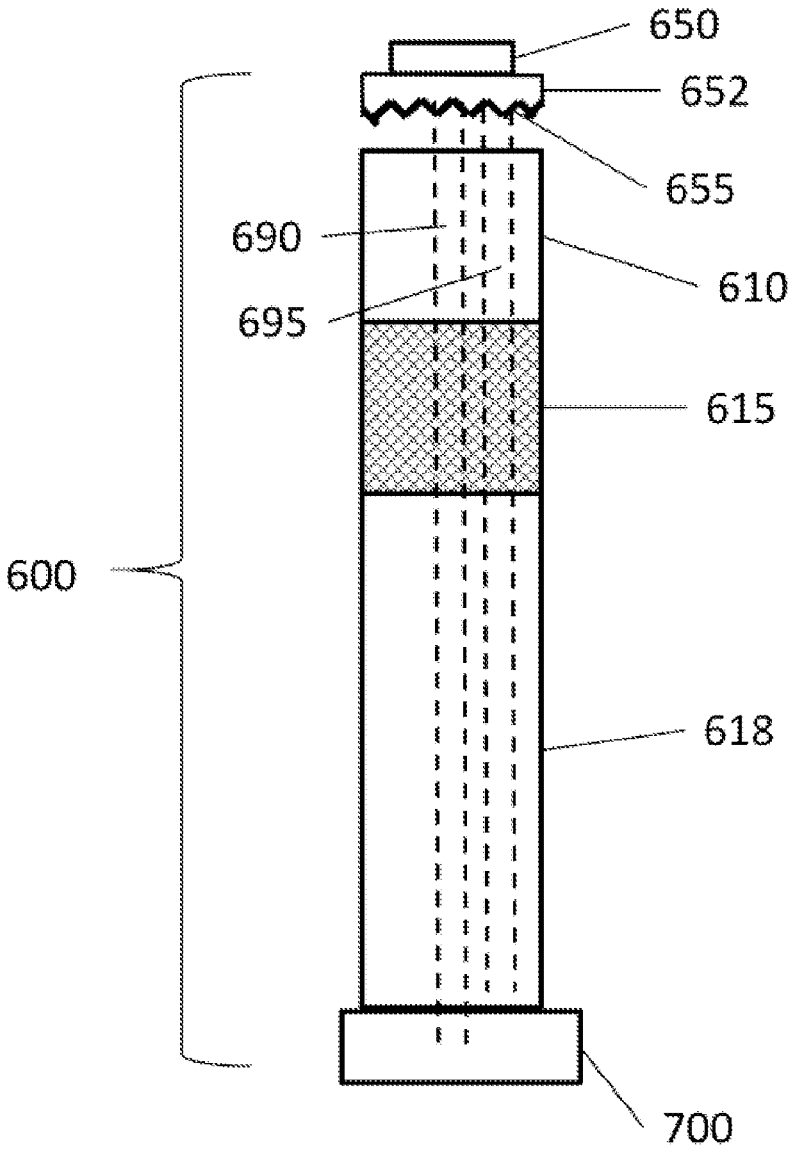
FIG. 10 illustrates a modular pintle for an adjustable swing-controlled hinge, wherein a contact arm is near a pintle's mechanism for securing to a knuckle of a hinge leaf.

FIG. 10 illustrates a modular pintle 600, which is composed of a first pintle module 610, a second pintle module 615, and a third pintle module 618.

The second pintle module 615 includes the swing arc 672, which engages a contact arm 250, as discussed above with respect to FIGS. 3 through 7, and may have an axial dimension measurement corresponding to a single knuckle or may have an axial dimension measurement corresponding to multiple knuckles.

As illustrated in FIG. 10, the second pintle module 615 has an axial dimension measurement corresponding to a single knuckle.

The first pintle module 615 and the third pintle module 618 do not include a swing arc 672, which engages a contact arm 250, as discussed above with respect to FIGS. 3 through 7. The first pintle module 615 and the third pintle module 618 may have an axial dimension measurement corresponding to a single knuckle or may have an axial dimension measurement corresponding to multiple knuckles.

As illustrated in FIG. 10, the first pintle module 615 has an axial dimension measurement corresponding to a single knuckle, and the third pintle module 618 has an axial dimension measurement corresponding to three knuckles.

Furthermore, as illustrated in FIG. 10, the modular pintle 600 has a first pintle cap 652 that includes teeth 655, which engage or bite into a knuckle of the hinge so that the modular pintle 600 does not move with respect to the knuckle when the modular pintle 600 is engaged thereto.

It is noted that the knuckle of the hinge may include corresponding teeth to engage the teeth 655 of the first pintle cap 652.

Alternatively, the teeth 655 of the first pintle cap 652 may engage or bite into the knuckle upon the application of an appropriate force so that the teeth 655 of the first pintle cap 652 bite into the knuckle, thereby preventing movement of the pintle cap 652 with respect to the knuckle.

The first pintle cap 652 also includes a first rod 690 and a second rod 695. The first rod 690 is connected to the first pintle cap 652 at one end and has threads at the other end to engage a second pintle cap 700.

The second rod 695 is connected, off-axis, to the first pintle cap 652. The second rod 695 prevents the pintle modules from rotating around the first rod 690.

It is noted that second pintle cap 700 may include the first rod 690 such that the first rod 690 is connected to the second pintle cap 700 at one end and has threads at the other end to engage the first pintle cap 652. However, in this alternative embodiment, the first pintle cap 652 still includes the second rod 695.

Figure 11:
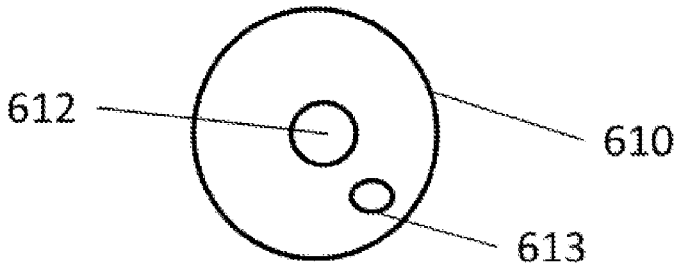
FIG. 11 illustrates a single module of the modular pintle of FIG. 8.

As illustrated in FIG. 11, each pintle module has a first opening 612 to allow the first rod 690 to pass therethrough and a second opening 613 to allow the first rod 695 to pass therethrough. The second rod 695, by passing through the second opening 613, prevents the pintle modules from rotating around the first rod 690.

The second pintle cap 700, into which first rod 690 screws, secures the engagement of the teeth 655 of the first pintle cap 652 with the knuckle to prevent movement of pintle 600 with respect to the knuckle.

The modular pintle 600 also includes a knob 650 to assist a user to lift the pintle cap 652 to disengage the pintle cap 652 from the knuckle. Upon disengagement, the modular pintle 600 can be rotated a desired distance and direction and then re-engaged with the knuckle.

Thus, the rotation of the modular pintle 600 can alter the effective swing arc or shift the location of the swing arc.

It is noted that the adjustable swing-controlled hinge can utilize pintles having various swing arcs so that rotation of the pintle may not be necessary to realize the desired swing arc.

As noted above, each knuckle includes an axial dimension and a radius dimension. Moreover, each pintle module has an axial dimension and a radius dimension.

Figure 12:
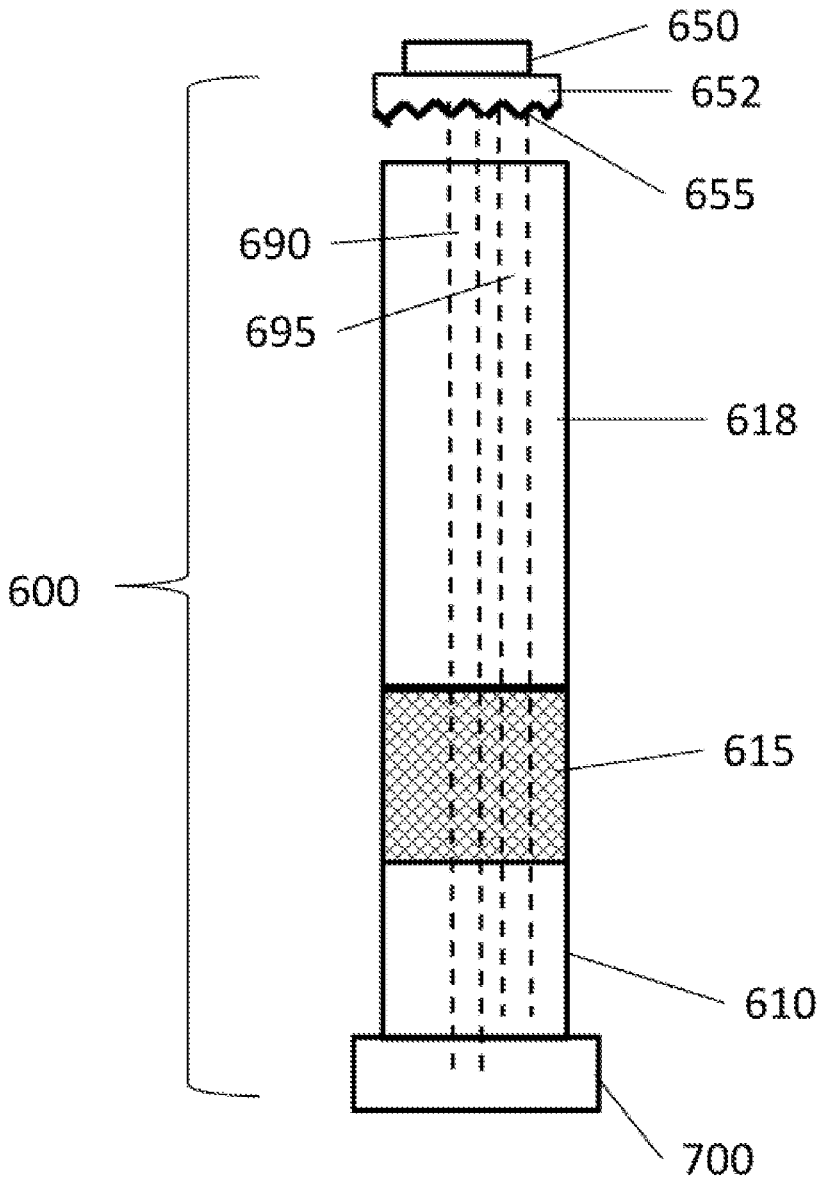
FIG. 12 illustrates a modular pintle for an adjustable swing-controlled hinge, wherein a contact arm is distal of a pintle's mechanism for securing to a knuckle of a hinge leaf.

FIG. 12 illustrates a modular pintle 600, wherein the positions of the pintle modules are changed so that the second pintle module 615, which includes the swing arc 672, engages a contact arm 250 associated with a knuckle closer to the second pintle cap 700.

As illustrated in FIG. 12, a modular pintle 600 is composed a first pintle module 610, a second pintle module 615, and a third pintle module 618.

The second pintle module 615 includes the swing arc 672, which engages a contact arm 250, as discussed above with respect to FIGS. 3 through 7, and may have an axial dimension measurement corresponding to a single knuckle or may have an axial dimension measurement corresponding to multiple knuckles.

As illustrated in FIG. 12, the second pintle module 615 has an axial dimension measurement corresponding to a single knuckle.

The first pintle module 615 and the third pintle module 618 do not include a swing arc 672, which engages a contact arm 250, as discussed above with respect to FIGS. 3 through 7. The first pintle module 615 and the third pintle module 618 may have an axial dimension measurement corresponding to a single knuckle or may have an axial dimension measurement corresponding to multiple knuckles.

As illustrated in FIG. 12, the first pintle module 615 has an axial dimension measurement corresponding to a single knuckle, and the third pintle module 618 has an axial dimension measurement corresponding to three knuckles.

Furthermore, as illustrated in FIG. 12, the modular pintle 600 has a first pintle cap 652 that includes teeth 655, which engage or bite into a knuckle of the hinge so that the modular pintle 600 does not move with respect to the knuckle when the modular pintle 600 is engaged thereto.

It is noted that the knuckle of the hinge may include corresponding teeth to engage the teeth 655 of the first pintle cap 652.

Alternatively, the teeth 655 of the first pintle cap 652 may engage or bite into the knuckle upon the application of an appropriate force so that the teeth 655 of the first pintle cap 652 bite into the knuckle, thereby preventing movement of the pintle cap 652 with respect to the knuckle.

The first pintle cap 652 also includes a first rod 690 and a second rod 695. The first rod 690 is connected to the first pintle cap 652 at one end and has threads at the other end to engage a second pintle cap 700.

The second rod 695 is connected, off-axis, to the first pintle cap 652. The second rod 695 prevents the pintle modules from rotating around the first rod 690.

It is noted that second pintle cap 700 may include the first rod 690 such that the first rod 690 is connected to the second pintle cap 700 at one end and has threads at the other end to engage the first pintle cap 652. However, in this alternative embodiment, the first pintle cap 652 still includes the second rod 695.

As illustrated in FIG. 11, each pintle module has a first opening 612 to allow the first rod 690 to pass therethrough and a second opening 613 to allow the first rod 695 to pass therethrough. The second rod 695, by passing through the second opening 613, prevents the pintle modules from rotating around the first rod 690.

As illustrated in FIG. 12, the second pintle cap 700, into which the first rod 690 screws, secures the engagement of the teeth 655 of the first pintle cap 652 with the knuckle to prevent movement of the modular pintle 600 with respect to the knuckle.

The modular pintle 600 also includes a knob 650 to assist a user to lift the first pintle cap 652 to disengage the first pintle cap 652 from the knuckle. Upon disengagement, the modular pintle 600 can be rotated a desired distance and direction and then re-engaged with the knuckle.

To rotate the modular pintle 600, the threads of the first rod 690 are backed out of the second pintle cap 700 enough for the teeth 655 of the first pintle cap 652 to disengage from the knuckle to allow free rotation thereof.

Thus, the rotation of the modular pintle 600 can alter the effective swing arc or shift the location of the swing arc.

It is noted that the adjustable swing-controlled hinge can utilize pintles having various swing arcs so that rotation of the pintle may not be necessary to realize the desired swing arc.

Figure 15:
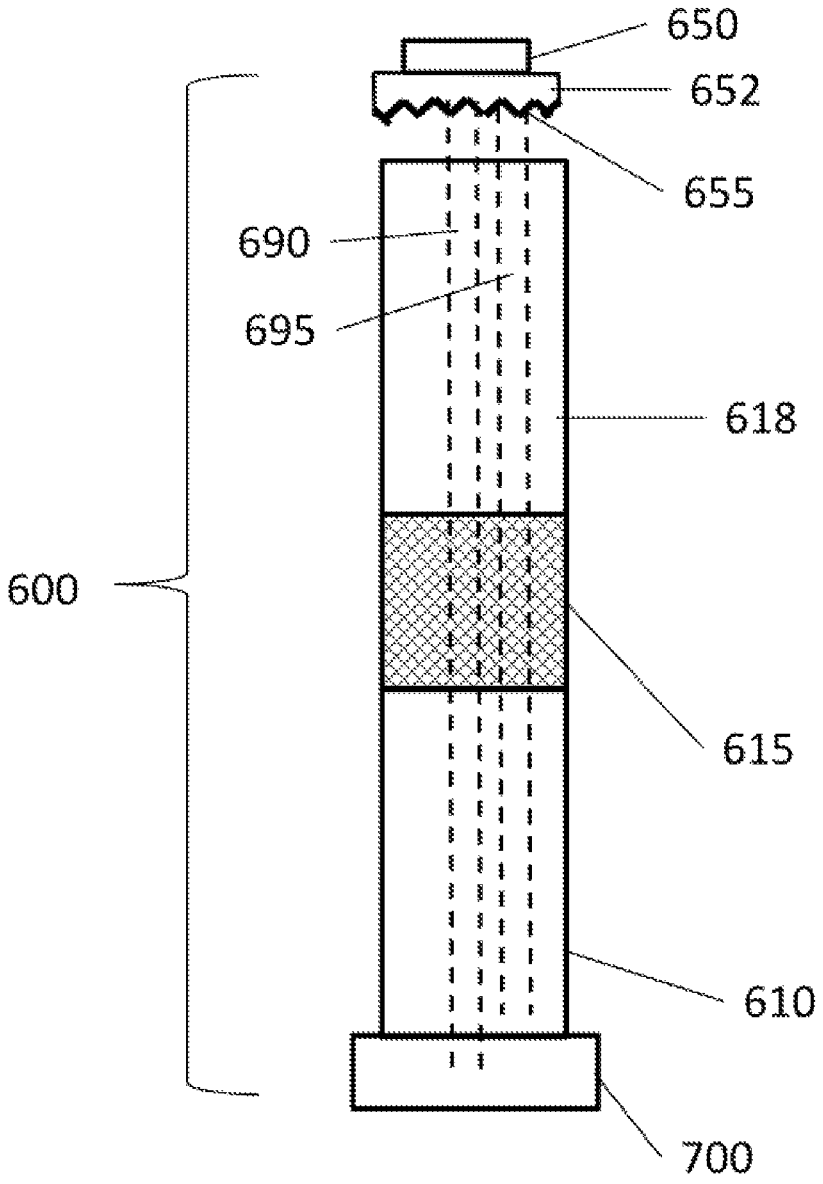
FIG. 15 illustrates a modular pintle for an adjustable swing-controlled hinge, wherein a contact arm is center of a pintle's mechanism for securing to a knuckle of a hinge leaf.

FIG. 15 illustrates a modular pintle 600, wherein the positions of the pintle modules are changed so that the second pintle module 615, which includes the swing arc 672, engages a contact arm 250 associated with a knuckle which is center of the hinge.

As illustrated in FIG. 15, a modular pintle 600 is composed a first pintle module 610, a second pintle module 615, and a third pintle module 618.

The second pintle module 615 includes the swing arc 672, which engages a contact arm 250, as discussed above with respect to FIGS. 3 through 7, and may have an axial dimension measurement corresponding to a single knuckle or may have an axial dimension measurement corresponding to multiple knuckles.

As illustrated in FIG. 15, the second pintle module 615 has an axial dimension measurement corresponding to a single knuckle.

The first pintle module 615 and the third pintle module 618 do not include a swing arc 672, which engages a contact arm 250, as discussed above with respect to FIGS. 3 through 7. The first pintle module 615 and the third pintle module 618 may have an axial dimension measurement corresponding to a single knuckle or may have an axial dimension measurement corresponding to multiple knuckles.

As illustrated in FIG. 15, the first pintle module 615 has an axial dimension measurement corresponding to a single knuckle, and the third pintle module 618 has an axial dimension measurement corresponding to three knuckles.

Furthermore, as illustrated in FIG. 15, the modular pintle 600 has a first pintle cap 652 that includes teeth 655, which engages a knuckle of the hinge so that the modular pintle 600 does not move with respect to the knuckle when the modular pintle 600 is engaged thereto.

It is noted that the knuckle of the hinge may include corresponding teeth to engage the teeth 655 of the first pintle cap 652.

Alternatively, the teeth 655 of the first pintle cap 652 may engage the knuckle upon the application of an appropriate force so that the teeth 655 of the first pintle cap 652 bite in the knuckle, thereby preventing movement of the pintle cap 652 with respect to the knuckle.

The first pintle cap 652 also includes a first rod 690 and a second rod 695. The first rod 690 is connected to the first pintle cap 652 at one end and has threads at the other end to engage a second pintle cap 700.

The second rod 695 is connected, off-axis, to the first pintle cap 652. The second rod 695 prevents the pintle modules from rotating around the first rod 690.

It is noted that second pintle cap 700 may include the first rod 690 such that the first rod 690 is connected to the second pintle cap 700 at one end and has threads at the other end to engage the first pintle cap 652. However, in this alternative embodiment, the first pintle cap 652 still includes the second rod 695.

As illustrated in FIG. 11, each pintle module has a first opening 612 to allow the first rod 690 to pass therethrough and a second opening 613 to allow the first rod 695 to pass therethrough. The second rod 695, by passing through the second opening 613, prevents the pintle modules from rotating around the first rod 690.

As illustrated in FIG. 15, the second pintle cap 700, into which the first rod 690 screws, secures the engagement of the teeth 655 of the first pintle cap 652 with the knuckle to prevent movement the modular pintle 600 with respect to the knuckle.

The modular pintle 600 also includes a knob 650 to assist a user to lift the first pintle cap 652 to disengage the first pintle cap 652 from the knuckle. Upon disengagement, the modular pintle 600 can be rotated a desired distance and direction and then re-engaged with the knuckle.

To rotate the modular pintle 600, the threads of the first rod 690 are backed out of the second pintle cap 700 enough for the teeth 655 of the first pintle cap 652 to disengage from the knuckle to allow free rotation thereof.

Thus, the rotation of the modular pintle 600 can alter the effective swing arc or shift the location of the swing arc.

It is noted that the adjustable swing-controlled hinge can utilize pintles having various swing arcs so that rotation of the pintle may not be necessary to realize the desired swing arc.

Figure 13:
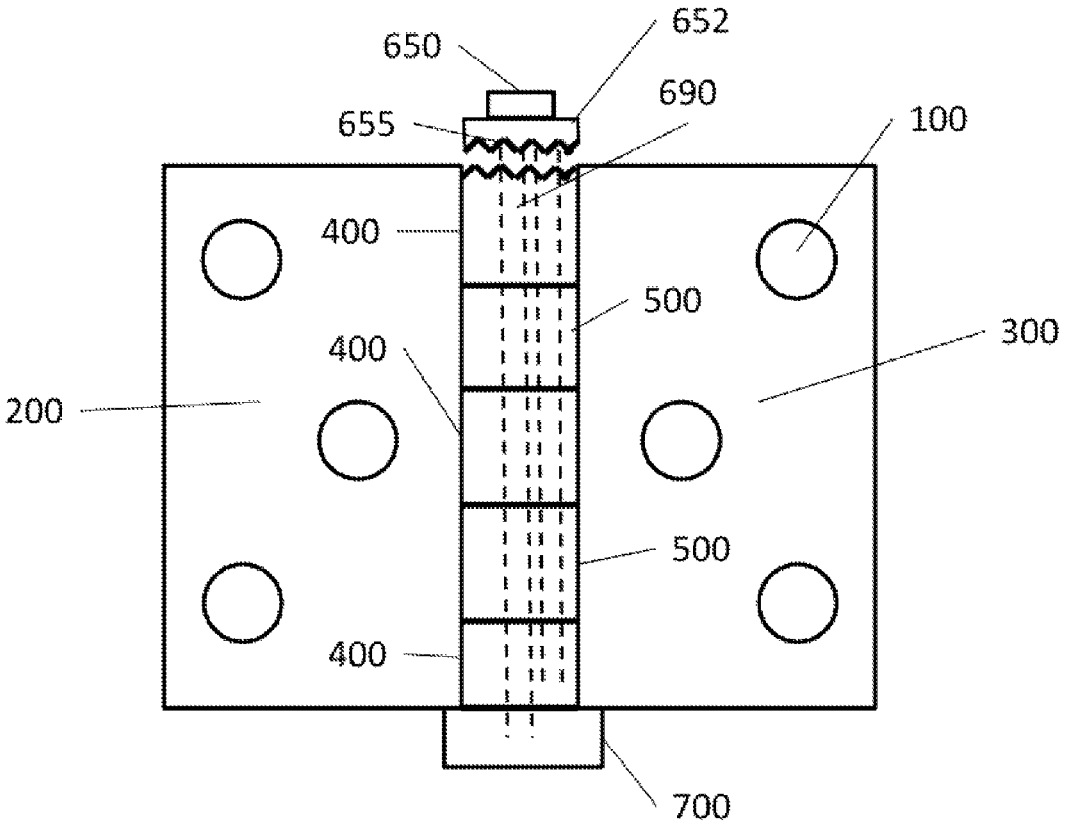
FIG. 13 illustrates an adjustable swing-controlled hinge with a modular pintle.

FIG. 13 illustrates an adjustable swing-controlled hinge using the modular pintle of FIG. 10, FIG. 12, or FIG. 15.

As illustrated in FIG. 13, the adjustable swing-controlled hinge includes a first hinge leaf 200, which includes openings 100 to enable the attaching of the first hinge leaf 200 to a door or a door frame. The adjustable swing-controlled hinge includes a second hinge leaf 300, which includes openings 100 to enable the attaching of the second hinge leaf 300 to a door or a door frame.

The first hinge leaf 200 includes knuckles 400, which form a cylindrical volume that is capable of receiving a modular pintle. The second hinge leaf 300 includes knuckles 500, which form a cylindrical volume that is capable of receiving the modular pintle.

It is noted that the knuckles 400 of first hinge leaf 200 are offset from knuckles 500 of second hinge leaf 300 such that when first hinge leaf 200 properly engages, as illustrated in FIG. 13, second hinge leaf 300, knuckles 400 and knuckles 500 form a cylindrical volume that is capable of receiving the modular pintle.

Additionally, as illustrated in FIG. 13, the first pintle cap 652 includes teeth 655, which engages a knuckle of the hinge so that the first pintle cap 652 does not move with respect to the knuckle when the modular pintle is engaged thereto.

It is noted that the knuckle of the hinge may include corresponding teeth to engage the teeth 655 of the first pintle cap 652.

Alternatively, the teeth 655 of the first pintle cap 652 may engage the knuckle upon the application of an appropriate force so that the teeth 655 of the first pintle cap 652 bite in the knuckle, thereby preventing movement of the modular pintle with respect to the knuckle.

The modular pintle includes a second pintle cap 700, into which the first rod 690 screws, to secure the engagement of the teeth 655 of the first pintle cap 652 with the knuckle to prevent movement of the modular pintle with respect to the knuckle.

It is noted that second pintle cap 700 may include the first rod 690 such that the first rod 690 is connected to the second pintle cap 700 at one end and has threads at the other end to engage the first pintle cap 652. However, in this alternative embodiment, the first pintle cap 652 still includes the second rod 695.

The first pintle cap 652 also includes a knob 650 to assist a user to lift the first pintle cap 652 to disengage the first pintle cap 652 from the knuckle. Upon disengagement, the first pintle cap 652 can be rotated a desired distance and direction and then re-engaged with the knuckle.

To rotate the modular pintle, the threads of the first rod 690 are backed out of the second pintle cap 700 enough for the teeth 655 of the first pintle cap 652 to disengage from the knuckle to allow free rotation thereof.

Thus, the rotation of the modular pintle can reduce the effective swing arc or shift the location of the swing arc.

It is noted that the adjustable swing-controlled hinge can utilize pintles having various swing arcs so that rotation of the pintle may not be necessary to realize the desired swing arc.

Figure 14:
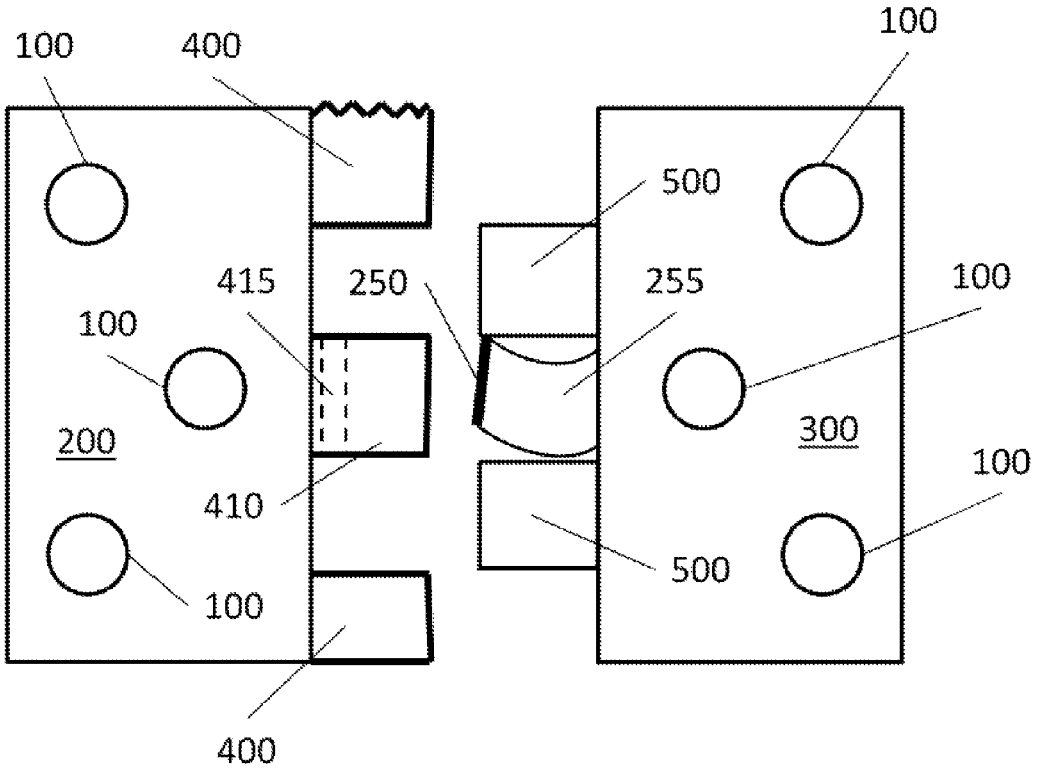
FIG. 14 illustrates an adjustable swing-controlled hinge having a pintle, hinge leaves, hinge knuckles, a pseudo knuckle, and a contact arm.

FIG. 14 illustrates an adjustable swing-controlled hinge using either one of the pintles illustrated in FIG. 4 through FIG. 7 or the modular pintle illustrated in FIG. 10, FIG. 12, or FIG. 15.

As illustrated in FIG. 14, the adjustable swing-controlled hinge includes a first hinge leaf 200, which includes openings 100 to enable the attaching of the first hinge leaf 200 to a door or a door frame. The adjustable swing-controlled hinge includes a second hinge leaf 300, which includes openings 100 to enable the attaching of the second hinge leaf 300 to a door or a door frame.

The first hinge leaf 200 includes knuckles 400, which form a cylindrical volume that is capable of receiving a pintle. The second hinge leaf 300 includes knuckles 500, which form a cylindrical volume that is capable of receiving a pintle.

It is noted that the knuckles 400 of first hinge leaf 200 are offset from knuckles 500 of second hinge leaf 300 such that when first hinge leaf 200 properly engages, as illustrated in FIG. 14, second hinge leaf 300, knuckles 400 and knuckles 500 form a cylindrical volume that is capable of receiving a pintle.

Additionally, as illustrated in FIG. 14, the first hinge leaf 200 includes a modified knuckle 410, which includes an opening 415. The opening 415 located near the first hinge leaf 200.

It is noted that the opening 415 may be a gap between the first hinge leaf 200 and modified knuckle 410.

Moreover, as illustrated in FIG. 14, the second hinge leaf 300 includes a pseudo knuckle 255, which includes contact arm 250.

The pseudo knuckle 255 is located on second hinge leaf 300 so that the pseudo knuckle 255 engages the modified knuckle 410 of the first hinge leaf 200 when first hinge leaf 200 properly engages the second hinge leaf 300 to form a hinge.

In addition, the pseudo knuckle 255 has a curvature to match the curvature of the outside surface of the modified knuckle 410.

When first hinge leaf 200 properly engages the second hinge leaf 300 to form a hinge, the contact arm 250 of the pseudo knuckle 255 is positioned to engage the pintle through the opening 415 of the modified knuckle 410.

In other words, the contact arm 250 is positioned in the opening 415 of the modified knuckle 410 such that the contact arm 250 comes in contact with the pintle at an abrupt stop end, a gradual stop end, or a gradual slowing swing arc; however, the contact arm 250 is positioned in the opening 415 of the modified knuckle 410 such that the contact arm 250 does not come in contact with the pintle at a free swing arc.

Figure 16:
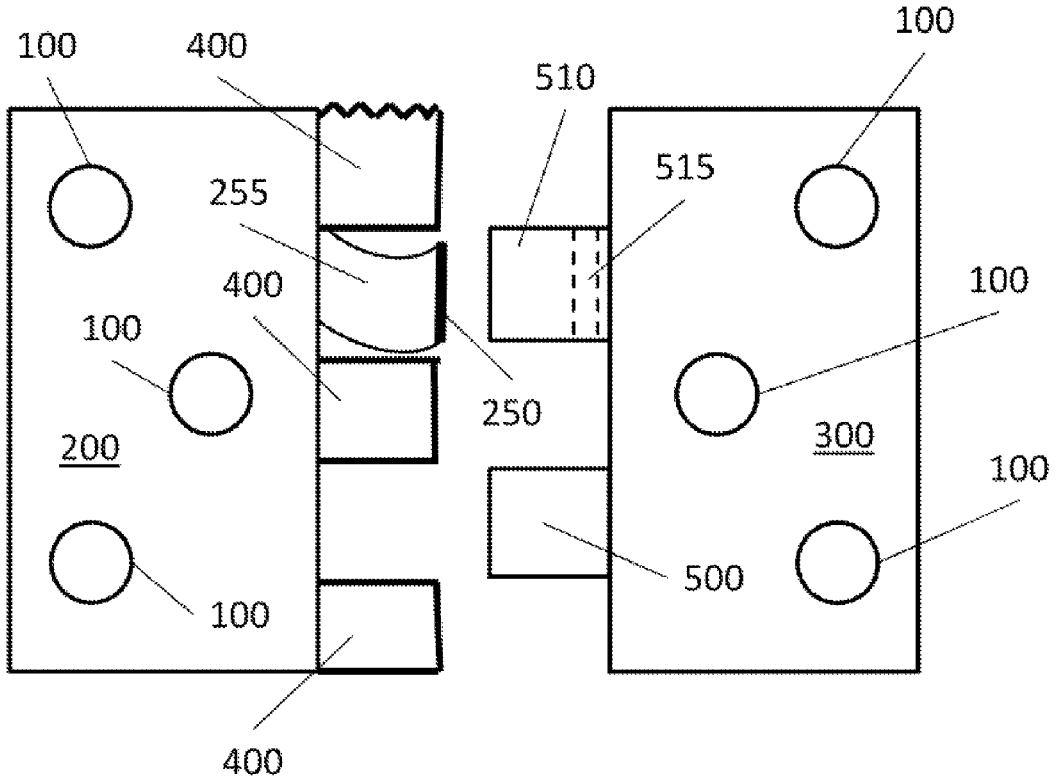
FIG. 16 illustrates another adjustable swing-controlled hinge having a pintle, hinge leaves, hinge knuckles, a pseudo knuckle, and a contact arm.

FIG. 16 illustrates another adjustable swing-controlled hinge using either one of the pintles illustrated in FIG. 4 through FIG. 7 or the modular pintle illustrated in FIG. 10, FIG. 12, or FIG. 15.

As illustrated in FIG. 16, the adjustable swing-controlled hinge includes a first hinge leaf 200, which includes openings 100 to enable the attaching of the first hinge leaf 200 to a door or a door frame. The adjustable swing-controlled hinge includes a second hinge leaf 300, which includes openings 100 to enable the attaching of the second hinge leaf 300 to a door or a door frame.

The first hinge leaf 200 includes knuckles 400, which form a cylindrical volume that is capable of receiving a pintle. The second hinge leaf 300 includes knuckles 500, which form a cylindrical volume that is capable of receiving a pintle.

It is noted that the knuckles 400 of first hinge leaf 200 are offset from knuckles 500 of second hinge leaf 300 such that when first hinge leaf 200 properly engages, as illustrated in FIG. 16, second hinge leaf 300, knuckles 400 and knuckles 500 form a cylindrical volume that is capable of receiving a pintle.

Additionally, as illustrated in FIG. 16, the second hinge leaf 300 includes a modified knuckle 510, which includes an opening 515. The opening 515 located near the second hinge leaf 300.

It is noted that the opening 515 may be a gap between the second hinge leaf 300 and modified knuckle 510.

Moreover, as illustrated in FIG. 16, the first hinge leaf 200 includes a pseudo knuckle 255, which includes contact arm 250.

The pseudo knuckle 255 is located on first hinge leaf 200 so that the pseudo knuckle 255 engages the modified knuckle 510 of the second hinge leaf 300 when first hinge leaf 200 properly engages the second hinge leaf 300 to form a hinge.

In addition, the pseudo knuckle 255 has a curvature to match the curvature of the outside surface of the modified knuckle 510.

When first hinge leaf 200 properly engages the second hinge leaf 300 to form a hinge, the contact arm 250 of the pseudo knuckle 255 is positioned to engage the pintle through the opening 515 of the modified knuckle 510.

In other words, the contact arm 250 is positioned in the opening 515 of the modified knuckle 510 such that the contact arm 250 comes in contact with the pintle at an abrupt stop end, a gradual stop end, or a gradual slowing swing arc; however, the contact arm 250 is positioned in the opening 515 of the modified knuckle 510 such that the contact arm 250 does not come in contact with the pintle at a free swing arc.

In operation, the adjustable swing-controlled hinge uses a pintle that may include an abrupt stop end (a right angle feature in the curvature of the pintle that engages the contact arm to enable an abrupt stop of the swing), a gradual stop end (a gradual changing curvature surface of the pintle that engages the contact arm to increase friction so as to enable a stop of the swing through frictional braking), a free swing zone or arc (a curvature surface of the pintle that does not engage the contact arm to enable a free swing), and a gradual slowing swing zone or arc (a gradual changing curvature surface of the pintle that engages the contact arm to increase friction so as to enable a slowing of the swing through frictional braking).

The gradual stop end of the pintle may be a rough convex niche surface area of the pintle that causes a leading edge of a contact arm to make frictional contact with the pintle. The contact between the contact arm and the rough convex niche surface area of the pintle causes the swing-rate of the hinge to decelerate to a slow frictional braking stop.

The gradual slowing swing zone or arc of the pintle may be a rough convex niche surface area of the pintle that causes a leading edge of a contact arm to make frictional contact with the pintle. However, the rough convex niche surface area of the gradual slowing swing zone or arc has a lesser change in surface slope than the rough convex niche surface area of the gradual stop end such that the contact between the contact arm and the rough convex niche surface area of the pintle causes the swing-rate of the hinge to decelerate without causing an actual stop.

Utilization of the pintle and contact arm, as described above, enables an operator to control an angle over which a hinge can turn, from nearly zero, up to the hinges total swing range.

Moreover, utilization of the pintle and contact arm, as described above, enables an operator to shift or rotate the swing arc.

It is noted that utilization of the pintle and contact arm, as described above, provides two types of stops, which are the movable and adjustable. One stop is an abrupt end-stop, and the other stop is a slow frictional braking end-stop.

In summary, a hinge for providing a swinging function for a first object attached thereto with respect to a stationary object attached thereto, includes a first leaf; a second leaf; and a pintle; the first leaf having a first knuckle forming a first volume for receiving the pintle; the second leaf having a second knuckle forming a second volume for receiving the pintle; the second knuckle having a contact arm located within the second volume; the pintle having a first stop surface feature and a second stop surface feature; the first stop surface feature causing the swinging function of the first object to stop when the contact arm of the second knuckle engages, by contact, the first stop surface feature; the second stop surface feature causing the swinging function of the first object to stop when the contact arm of the second knuckle engages, by contact, the second stop surface feature.

The pintle may include a free swing surface feature such that the contact arm of the second knuckle engages, without contact, the free swing surface feature.

The first stop surface feature may be a substantially orthogonal feature in a surface of the pintle such that the first stop surface feature causes the swinging function of the first object to realize an abrupt stop when the contact arm of the second knuckle engages, by contact, the first stop surface feature.

The first stop surface feature may be a sloping surface feature of the pintle such that the first stop surface feature causes the swinging function of the first object to realize a gradual stop when the contact arm of the second knuckle engages, by contact, the first stop surface feature.

The pintle may include a gradual slowing swing surface feature; the gradual slowing swing surface feature causing the swinging function of the first object to decelerate when the contact arm of the second knuckle engages, by frictional contact, the gradual slowing swing surface.

The pintle may include a free swing surface feature such that the contact arm of the second knuckle engages, without contact, the free swing surface feature; the first stop surface feature being a substantially orthogonal feature in a surface of the pintle such that the first stop surface feature causes the swinging function of the first object to realize an abrupt stop when the contact arm of the second knuckle engages, by contact, the first stop surface feature; the second stop surface feature being a substantially orthogonal feature in a surface of the pintle such that the second stop surface feature causes the swinging function of the first object to realize an abrupt stop when the contact arm of the second knuckle engages, by contact, the second stop surface feature; the free swing surface feature being located between the first stop surface feature and the second stop surface feature.

The pintle may include a free swing surface feature such that the contact arm of the second knuckle engages, without contact, the free swing surface feature; the first stop surface feature being a sloping surface feature of the pintle such that the first stop surface feature causes the swinging function of the first object to realize a gradual stop when the contact arm of the second knuckle engages, by contact, the first stop surface feature; the second stop surface feature being a sloping surface feature of the pintle such that the second stop surface feature causes the swinging function of the first object to realize a gradual stop when the contact arm of the second knuckle engages, by contact, the second stop surface feature; the free swing surface feature being located between the first stop surface feature and the second stop surface feature.

The pintle may include a free swing surface feature such that the contact arm of the second knuckle engages, without contact, the free swing surface feature; the first stop surface feature being a substantially orthogonal feature in a surface of the pintle such that the first stop surface feature causes the swinging function of the first object to realize an abrupt stop when the contact arm of the second knuckle engages, by contact, the first stop surface feature; the second stop surface feature being a substantially orthogonal feature in a surface of the pintle such that the second stop surface feature causes the swinging function of the first object to realize an abrupt stop when the contact arm of the second knuckle engages, by contact, the second stop surface feature; the free swing surface feature being located between the first stop surface feature and the second stop surface feature.

The pintle may include a free swing surface feature such that the contact arm of the second knuckle engages, without contact, the free swing surface feature; a first gradual slowing swing surface feature; and a second gradual slowing swing surface feature; the first gradual slowing swing surface feature causing the swinging function of the first object to decelerate when the contact arm of the second knuckle engages, by frictional contact, the first gradual slowing swing surface; the second gradual slowing swing surface feature causing the swinging function of the first object to decelerate when the contact arm of the second knuckle engages, by frictional contact, the first gradual slowing swing surface; the first stop surface feature being a sloping surface feature of the pintle such that the first stop surface feature causes the swinging function of the first object to realize a gradual stop when the contact arm of the second knuckle engages, by contact, the first stop surface feature; the second stop surface feature being a sloping surface feature of the pintle such that the second stop surface feature causes the swinging function of the first object to realize a gradual stop when the contact arm of the second knuckle engages, by contact, the second stop surface feature; the free swing surface feature being located between the first gradual slowing swing surface feature and the second gradual slowing swing surface feature; the first gradual slowing swing surface feature being located between the free swing surface feature and the first stop surface feature; the second gradual slowing swing surface feature being located between the free swing surface feature and the second stop surface feature.

The pintle may include an engagement member to engage the first knuckle such that the first knuckle is non-rotational with respect to the pintle and the second knuckle pintle is rotational with respect the pintle.

The pintle may be modular and include a first pintle module and a second pintle module; the first pintle module including the first stop surface feature and the second stop surface feature.

A hinge for providing a swinging function for a first object attached thereto with respect to a stationary object attached thereto, includes a first leaf; a second leaf; and a pintle; the first leaf having a first knuckle, a second knuckle, and a third knuckle; the second knuckle forming a volume for receiving the pintle; the second knuckle having an opening; the second leaf having a fourth knuckle and a fifth knuckle; the second leaf including a pseudo knuckle located between the fourth knuckle and the fifth knuckle; the pseudo knuckle having a contact arm; the contact arm of the pseudo knuckle engaging the pintle through the opening of the second knuckle when the first hinge leaf engages the second hinge leaf to form the hinge; the pintle having a first stop surface feature and a second stop surface feature; the first stop surface feature causing the swinging function of the first object to stop when the contact arm of the pseudo knuckle engages, by contact, the first stop surface feature; the second stop surface feature causing the swinging function of the first object to stop when the contact arm of the pseudo knuckle engages, by contact, the second stop surface feature.

The pintle may include a free swing surface feature such that the contact arm of the pseudo knuckle engages, without contact, the free swing surface feature.

The first stop surface feature may be a substantially orthogonal feature in a surface of the pintle such that the first stop surface feature causes the swinging function of the first object to realize an abrupt stop when the contact arm of the pseudo knuckle engages, by contact, the first stop surface feature.

The first stop surface feature may be a sloping surface feature of the pintle such that the first stop surface feature causes the swinging function of the first object to realize a gradual stop when the contact arm of the pseudo knuckle engages, by contact, the first stop surface feature.

The pintle may include a gradual slowing swing surface feature; the gradual slowing swing surface feature causing the swinging function of the first object to decelerate when the contact arm of the pseudo knuckle engages, by frictional contact, the gradual slowing swing surface.

The pintle may include a free swing surface feature such that the contact arm of the pseudo knuckle engages, without contact, the free swing surface feature; the first stop surface feature being a substantially orthogonal feature in a surface of the pintle such that the first stop surface feature causes the swinging function of the first object to realize an abrupt stop when the contact arm of the pseudo knuckle engages, by contact, the first stop surface feature; the second stop surface feature being a substantially orthogonal feature in a surface of the pintle such that the second stop surface feature causes the swinging function of the first object to realize an abrupt stop when the contact arm of the pseudo knuckle engages, by contact, the second stop surface feature; the free swing surface feature being located between the first stop surface feature and the second stop surface feature.

The pintle may include a free swing surface feature such that the contact arm of the pseudo knuckle engages, without contact, the free swing surface feature; the first stop surface feature being a sloping surface feature of the pintle such that the first stop surface feature causes the swinging function of the first object to realize a gradual stop when the contact arm of the pseudo knuckle engages, by contact, the first stop surface feature; the second stop surface feature being a sloping surface feature of the pintle such that the second stop surface feature causes the swinging function of the first object to realize a gradual stop when the contact arm of the pseudo knuckle engages, by contact, the second stop surface feature; the free swing surface feature being located between the first stop surface feature and the second stop surface feature.

The pintle may include a free swing surface feature such that the contact arm of the pseudo knuckle engages, without contact, the free swing surface feature; the first stop surface feature being a substantially orthogonal feature in a surface of the pintle such that the first stop surface feature causes the swinging function of the first object to realize an abrupt stop when the contact arm of the pseudo knuckle engages, by contact, the first stop surface feature; the second stop surface feature being a sloping surface feature of the pintle such that the second stop surface feature causes the swinging function of the first object to realize a gradual stop when the contact arm of the pseudo knuckle engages, by contact, the second stop surface feature; the free swing surface feature being located between the first stop surface feature and the second stop surface feature.

A hinge for providing a swinging function for a first object attached thereto with respect to a stationary object attached thereto, comprising a first leaf; a second leaf; and a modular pintle; the modular pintle being composed of a first pintle module, a second pintle module, and a third pintle module; the first leaf having a first knuckle forming a first volume for receiving the first pintle module and a second knuckle forming a second volume for receiving the third pintle module; the second leaf having a third knuckle forming a third volume for receiving the second pintle module; the second knuckle having a contact arm located within the third volume; the second pintle module having a first stop surface feature and a second stop surface feature; the first stop surface feature causing the swinging function of the first object to stop when the contact arm of the second knuckle engages, by contact, the first stop surface feature; the second stop surface feature causing the swinging function of the first object to stop when the contact arm of the second knuckle engages, by contact, the second stop surface feature.

It will be appreciated that variations of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the description above and the following claims.

What is claimed is:

1. A hinge for providing a swinging function for a first object attached thereto with respect to a stationary object attached thereto, comprising:

a first leaf;

a second leaf; and a pintle;

said first leaf having a first knuckle forming a first volume for receiving said pintle;

said second leaf having a second knuckle forming a second volume for receiving said pintle;

said second knuckle having a contact arm projecting away from an inner surface of said second knuckle and projecting into said second volume;

said pintle having a first stop surface feature, a free swing surface feature, and a second stop surface feature;

said first stop surface feature causing the swinging function of the first object to stop when said contact arm of said second knuckle engages, by contact, said first stop surface feature, the hinge being in an open position when the swinging function of the first object is stopped by said contact arm of said second knuckle engaging, by contact, said first stop surface feature;

said second stop surface feature causing the swinging function of the first object to stop when said contact arm of said second knuckle engages, by contact, said second stop surface feature, the hinge being in a closed position when the swinging function of the first object is stopped by said contact arm of said second knuckle engaging, by contact, said second stop surface feature;

said contact arm of said second knuckle traversing, without contacting, said free swing surface feature.

2. The hinge, as claimed in claim 1, wherein said first stop surface feature is a substantially orthogonal feature in a surface of said pintle such that said first stop surface feature causes the swinging function of the first object to realize an abrupt stop when said contact arm of said second knuckle engages, by contact, said first stop surface feature.

3. The hinge, as claimed in claim 1, wherein said first stop surface feature is a sloping surface feature of said pintle such that said first stop surface feature causes the swinging function of the first object to realize a gradual stop when said contact arm of said second knuckle engages, by contact, said first stop surface feature.

4. The hinge, as claimed in claim 1, wherein said pintle includes a gradual slowing swing surface feature;

said gradual slowing swing surface feature causing the swinging function of the first object to decelerate when said contact arm of said second knuckle engages, by frictional contact, said gradual slowing swing surface.

5. The hinge, as claimed in claim 1, wherein said first stop surface feature is a substantially orthogonal feature in a surface of said pintle such that said first stop surface feature causes the swinging function of the first object to realize an abrupt stop when said contact arm of said second knuckle engages, by contact, said first stop surface feature;

said second stop surface feature being a substantially orthogonal feature in a surface of said pintle such that said second stop surface feature causes the swinging function of the first object to realize an abrupt stop when said contact arm of said second knuckle engages, by contact, said second stop surface feature;

said free swing surface feature being located between said first stop surface feature and said second stop surface feature.

6. The hinge, as claimed in claim 1, wherein said first stop surface feature is a sloping surface feature of said pintle such that said first stop surface feature causes the swinging function of the first object to realize a gradual stop when said contact arm of said second knuckle engages, by contact, said first stop surface feature;

said second stop surface feature being a sloping surface feature of said pintle such that said second stop surface feature causes the swinging function of the first object to realize a gradual stop when said contact arm of said second knuckle engages, by contact, said second stop surface feature;

said free swing surface feature being located between said first stop surface feature and said second stop surface feature.

7. The hinge, as claimed in claim 1, wherein said first stop surface feature is a substantially orthogonal feature in a surface of said pintle such that said first stop surface feature causes the swinging function of the first object to realize an abrupt stop when said contact arm of said second knuckle engages, by contact, said first stop surface feature;

said second stop surface feature being a sloping surface feature of said pintle such that said second stop surface feature causes the swinging function of the first object to realize a gradual stop when said contact arm of said second knuckle engages, by contact, said second stop surface feature;

said free swing surface feature being located between said first stop surface feature and said second stop surface feature.

8. The hinge, as claimed in claim 1, wherein said pintle includes a first gradual slowing swing surface feature; and a second gradual slowing swing surface feature;

said first gradual slowing swing surface feature causing the swinging function of the first object to decelerate when said contact arm of said second knuckle engages, by frictional contact, said first gradual slowing swing surface;

said second gradual slowing swing surface feature causing the swinging function of the first object to decelerate when said contact arm of said second knuckle engages, by frictional contact, said first gradual slowing swing surface;

said first stop surface feature being a sloping surface feature of said pintle such that said first stop surface feature causes the swinging function of the first object to realize a gradual stop when said contact arm of said second knuckle engages, by contact, said first stop surface feature;

said second stop surface feature being a sloping surface feature of said pintle such that said second stop surface feature causes the swinging function of the first object to realize a gradual stop when said contact arm of said second knuckle engages, by contact, said second stop surface feature;

said free swing surface feature being located between said first gradual slowing swing surface feature and said second gradual slowing swing surface feature;

said first gradual slowing swing surface feature being located between said free swing surface feature and said first stop surface feature;

said second gradual slowing swing surface feature being located between said free swing surface feature and said second stop surface feature.

9. The hinge, as claimed in claim 1, wherein said pintle includes an engagement member to engage said first knuckle such that said first knuckle is non-rotational with respect to said pintle and said second knuckle is rotational with respect said pintle.

10. The hinge, as claimed in claim 1, wherein said pintle is modular and includes a first pintle module and a second pintle module;

said first pintle module including said first stop surface feature and said second stop surface feature.

11. A hinge for providing a swinging function for a first object attached thereto with respect to a stationary object attached thereto, comprising:

a first leaf;

a second leaf; and a pintle;

said first leaf having a first knuckle;

said first knuckle forming a volume for receiving said pintle;

said first knuckle having an opening;

said second leaf having a second knuckle and a third knuckle;

said second leaf including a pseudo knuckle located between said second knuckle and said third knuckle;

said pseudo knuckle having a contact arm;

said contact arm of said pseudo knuckle engaging said pintle through said opening of said first knuckle when said first hinge leaf engages said second hinge leaf to form the hinge;

said pintle having a first stop surface feature and a second stop surface feature;

said first stop surface feature causing the swinging function of the first object to stop when said contact arm of said pseudo knuckle engages, by contact, said first stop surface feature;

said second stop surface feature causing the swinging function of the first object to stop when said contact arm of said pseudo knuckle engages, by contact, said second stop surface feature.

12. The hinge, as claimed in claim 11, wherein said pintle includes a free swing surface feature such that said contact arm of said pseudo knuckle traverses, without contacting, said free swing surface feature.

13. The hinge, as claimed in claim 11, wherein said first stop surface feature is a substantially orthogonal feature in a surface of said pintle such that said first stop surface feature causes the swinging function of the first object to realize an abrupt stop when said contact arm of said pseudo knuckle engages, by contact, said first stop surface feature.

14. The hinge, as claimed in claim 11, wherein said first stop surface feature is a sloping surface feature of said pintle such that said first stop surface feature causes the swinging function of the first object to realize a gradual stop when said contact arm of said pseudo knuckle engages, by contact, said first stop surface feature.

15. The hinge, as claimed in claim 11, wherein said pintle includes a gradual slowing swing surface feature;

said gradual slowing swing surface feature causing the swinging function of the first object to decelerate when said contact arm of said pseudo knuckle engages, by frictional contact, said gradual slowing swing surface.

16. The hinge, as claimed in claim 11, wherein said pintle includes a free swing surface feature such that said contact arm of said pseudo knuckle traverses, without contacting, said free swing surface feature;

said first stop surface feature being a substantially orthogonal feature in a surface of said pintle such that said first stop surface feature causes the swinging function of the first object to realize an abrupt stop when said contact arm of said pseudo knuckle engages, by contact, said first stop surface feature;

said second stop surface feature being a substantially orthogonal feature in a surface of said pintle such that said second stop surface feature causes the swinging function of the first object to realize an abrupt stop when said contact arm of said pseudo knuckle engages, by contact, said second stop surface feature;

said free swing surface feature being located between said first stop surface feature and said second stop surface feature.

17. The hinge, as claimed in claim 11, wherein said pintle includes a free swing surface feature such that said contact arm of said pseudo knuckle traverses, without contacting, said free swing surface feature;

said first stop surface feature being a sloping surface feature of said pintle such that said first stop surface feature causes the swinging function of the first object to realize a gradual stop when said contact arm of said pseudo knuckle engages, by contact, said first stop surface feature;

said second stop surface feature being a sloping surface feature of said pintle such that said second stop surface feature causes the swinging function of the first object to realize a gradual stop when said contact arm of said pseudo knuckle engages, by contact, said second stop surface feature;

said free swing surface feature being located between said first stop surface feature and said second stop surface feature.

18. The hinge, as claimed in claim 11, wherein said pintle includes a free swing surface feature such that said contact arm of said pseudo knuckle traverses, without contacting, said free swing surface feature;

said first stop surface feature being a substantially orthogonal feature in a surface of said pintle such that said first stop surface feature causes the swinging function of the first object to realize an abrupt stop when said contact arm of said pseudo knuckle engages, by contact, said first stop surface feature;

said second stop surface feature being a sloping surface feature of said pintle such that said second stop surface feature causes the swinging function of the first object to realize a gradual stop when said contact arm of said pseudo knuckle engages, by contact, said second stop surface feature;

said free swing surface feature being located between said first stop surface feature and said second stop surface feature.

19. A hinge for providing a swinging function for a first object attached thereto with respect to a stationary object attached thereto, comprising:

a first leaf;

a second leaf; and a modular pintle;

said modular pintle being composed of a first pintle module, a second pintle module, and a third pintle module;

said first leaf having a first knuckle forming a first volume for receiving said first pintle module and a second knuckle forming a second volume for receiving said third pintle module;

said second leaf having a third knuckle forming a third volume for receiving said second pintle module;

said second knuckle having a contact arm located within said third volume;

said second pintle module having a first stop surface feature and a second stop surface feature;

said first stop surface feature causing the swinging function of the first object to stop when said contact arm of said second knuckle engages, by contact, said first stop surface feature, the hinge being in an open position when the swinging function of the first object is stopped by said contact arm of said second knuckle engaging, by contact, said first stop surface feature;

said second stop surface feature causing the swinging function of the first object to stop when said contact arm of said second knuckle engages, by contact, said second stop surface feature, the hinge being in a closed position when the swinging function of the first object is stopped by said contact arm of said second knuckle engaging, by contact, said second stop surface feature.

* * * * *